US010801214B1

(12) United States Patent
Byrd et al.

(10) Patent No.: US 10,801,214 B1
(45) Date of Patent: Oct. 13, 2020

(54) COVERING STRUCTURE AND METHOD FOR DOCKS

(71) Applicants: Steven Monroe Byrd, New Port Richey, FL (US); William Jeffrey McIntyre, New Port Richey, FL (US)

(72) Inventors: Steven Monroe Byrd, New Port Richey, FL (US); William Jeffrey McIntyre, New Port Richey, FL (US)

( * ) Notice: Subject to any disclaimer, the term of this patent is extended or adjusted under 35 U.S.C. 154(b) by 0 days.

(21) Appl. No.: 16/248,027

(22) Filed: Jan. 15, 2019

Related U.S. Application Data

(60) Provisional application No. 62/686,947, filed on Jun. 19, 2018.

(51) Int. Cl.
*E04F 15/02* (2006.01)
*E02B 3/06* (2006.01)

(52) U.S. Cl.
CPC ..... *E04F 15/02183* (2013.01); *E02B 3/068* (2013.01); *E04F 15/0215* (2013.01); *E04F 15/02161* (2013.01)

(58) Field of Classification Search
CPC ..... E04F 15/02183; E04F 15/0215; E04F 15/02161; E02B 3/068
See application file for complete search history.

(56) References Cited

U.S. PATENT DOCUMENTS 4,885,882 A * 12/1989 Forshee ..... B63B 3/48 52/177
4,907,387 A * 3/1990 Turnbull ..... E04F 15/02183 52/177

* cited by examiner

*Primary Examiner* — Patrick J Maestri
(74) *Attorney, Agent, or Firm* — John Rizvi; John Rizvi, P.A.—The Patent Professor

(57) ABSTRACT

A covering structure and method for a dock is disclosed. The structure may include a top surface, and a bottom surface. At least one of the top surface and the bottom surface includes one or more indentations. The structure includes a downward projection extending along each of a first edge and the second edge. The one or more indentations may be configured to drain fluid. The downward projections extend downwardly over vertical sides of the dock for covering and protecting at least a portion of vertical sides of the dock. The one or more indentations may be configured to receive an adhesive for gripping the dock. The one or more indentations may have one or more sloped walls. The covering structure is resistant to heat absorption and ultra-violet radiation. The covering structure is entirely a single piece. At least one of the top surface and bottom surface is roughened.

20 Claims, 3 Drawing Sheets

COVERING STRUCTURE AND METHOD FOR DOCKS

CROSS-REFERENCE TO RELATED APPLICATION

This application claims the benefit of U.S. Provisional Patent Application Ser. No. 62/686,947, filed Jun. 19, 2018, which is incorporated herein in its entirety.

FIELD OF THE INVENTION

The present invention relates generally to flooring, and more particularly to protective flooring for outdoor docks or decks.

BACKGROUND OF THE INVENTION

Docks (sometimes referred to as piers), are raised structures in bodies of water, and are used to dock boats. Docks may range in size and complexity, and may be made of various materials such as aluminum, wood, or composites. They typically extend out from land or a beach, and may allow tides to flow underneath generally undisturbed. A deck generally refers to an outdoor floor structure. For example, a boat or even a building may have a deck.

Generally, docks and decks suffer from various issues. They are typically subject to severe weather conditions and other environmental factors such as direct sunlight for long periods of time. Therefore, docks and decks may require yearly maintenance, which is extremely inconvenient and costly.

Existing solutions to these problems include installing protective films or painting. But such existing solutions are either very expensive, are hard to install, are not durable (requiring yearly maintenance), are not reliably attachable, or are too hot to the touch when exposed to direct sunlight or heat.

Therefore, there exists a need for a covering system for docks and decks that is durable, easy, cheap to install, and that does not get too hot.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

As an example, disclosed is a covering structure for a dock, the covering structure comprising:

a top surface;

a bottom surface;

wherein the top surface and bottom surface extend between a first edge and a second edge; and wherein at least one of the top surface and the bottom surface includes one or more indentations.

In another aspect, the covering structure includes a downward projection on each of the first edge and the second edge.

In another aspect, the covering structure includes a downward projection extending along each of the first edge and the second edge.

In another aspect, the one or more indentations extend between a third edge and a fourth edge, wherein the third edge and fourth edge are parallel with one another and perpendicular to the first edge and second edge.

In another aspect, the one or more indentations are configured to drain fluid.

In another aspect, the structure is configured to be installed on a dock, by extending laterally over the dock, and wherein the covering structure includes a downward projection on each of the first edge and the second edge to extend downwardly over vertical sides of the dock, or vertically between floorboards of the dock.

In another aspect, the structure is configured to be installed on a dock, by extending laterally over the dock, and wherein the covering structure includes a downward projection extending along each of the first edge and the second edge to extend downwardly over vertical sides of the dock for covering and protecting at least a portion of vertical sides of the dock, or vertically between floorboards of the dock for protecting vertical portions of the floorboards.

In another aspect, the one or more indentations are configured to receive an adhesive for gripping the dock.

In another aspect, the one or more indentations have one or more sloped walls.

In another aspect, the one or more indentations have one or more sloped walls, such that the one or more indentations have a wider top than a bottom of the one or more indentations.

In another aspect, wherein the one or more indentations includes a groove that is extruded in a manufacturing process of the covering structure.

In another aspect, wherein the one or more indentations are effected by an embossing wheel to roughen at least one of the top surface and bottom surface.

In another aspect, the covering structure is resistant to heat absorption to prevent burning skin of a user touching the covering structure, and resistant to ultra-violet radiation.

In another aspect, the covering structure is entirely a single piece.

In another aspect, at least one of the top surface and the bottom surface are at least one of textured and roughened to improve grip.

As another example, disclosed is a covering structure for a dock, the covering structure comprising:

a top surface;

a bottom surface;

wherein the top surface and bottom surface extend between a first edge and a second edge;

wherein at least one of the top surface and the bottom surface includes one or more indentations;

wherein the covering structure includes a downward projection extending along each of the first edge and the second edge;

wherein the one or more indentations extend between a third edge and a fourth edge, wherein the third edge and fourth edge are parallel with one another and perpendicular to the first edge and second edge;

wherein the one or more indentations are configured to drain fluid;

wherein the structure is configured to be installed on a dock, by extending laterally over the dock, and wherein the downward projections extend downwardly over vertical sides of the dock for covering and protecting at least a portion of vertical sides of the dock, or vertically between floorboards of the dock for protecting vertical portions of the floorboards;

wherein the one or more indentations are configured to receive an adhesive for gripping the dock;

wherein the one or more indentations have one or more sloped walls;

wherein the one or more indentations includes a groove that is extruded in a manufacturing process of the covering structure;

wherein the covering structure is resistant to heat absorption to prevent burning skin of a user touching the covering structure, and resistant to ultra-violet radiation;

wherein the covering structure is entirely a single piece; and wherein at least one of the top surface and bottom surface are roughened.

As another example, disclosed is a method of covering a dock, the method comprising:

providing a covering structure for a dock, the covering structure comprising, a top surface and a bottom surface, wherein the top surface and bottom surface extend between a first edge and a second edge, wherein at least one of the top surface and the bottom surface includes one or more indentations; and placing the covering structure on the dock.

In another aspect, the covering structure includes a downward projection on each of the first edge and the second edge; and wherein the method further comprises placing the projections on opposite vertical sides of the dock, or vertically between floorboards of the dock for protecting vertical portions of the floorboards.

In another aspect, the method further comprises placing an adhesive on the dock before placing the covering structure on the dock, such that the covering structure is placed on the adhesive to adhere the covering structure to the dock.

In another aspect, the method further comprises roughening at least one of the top surface and bottom surface with an embossing wheel.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
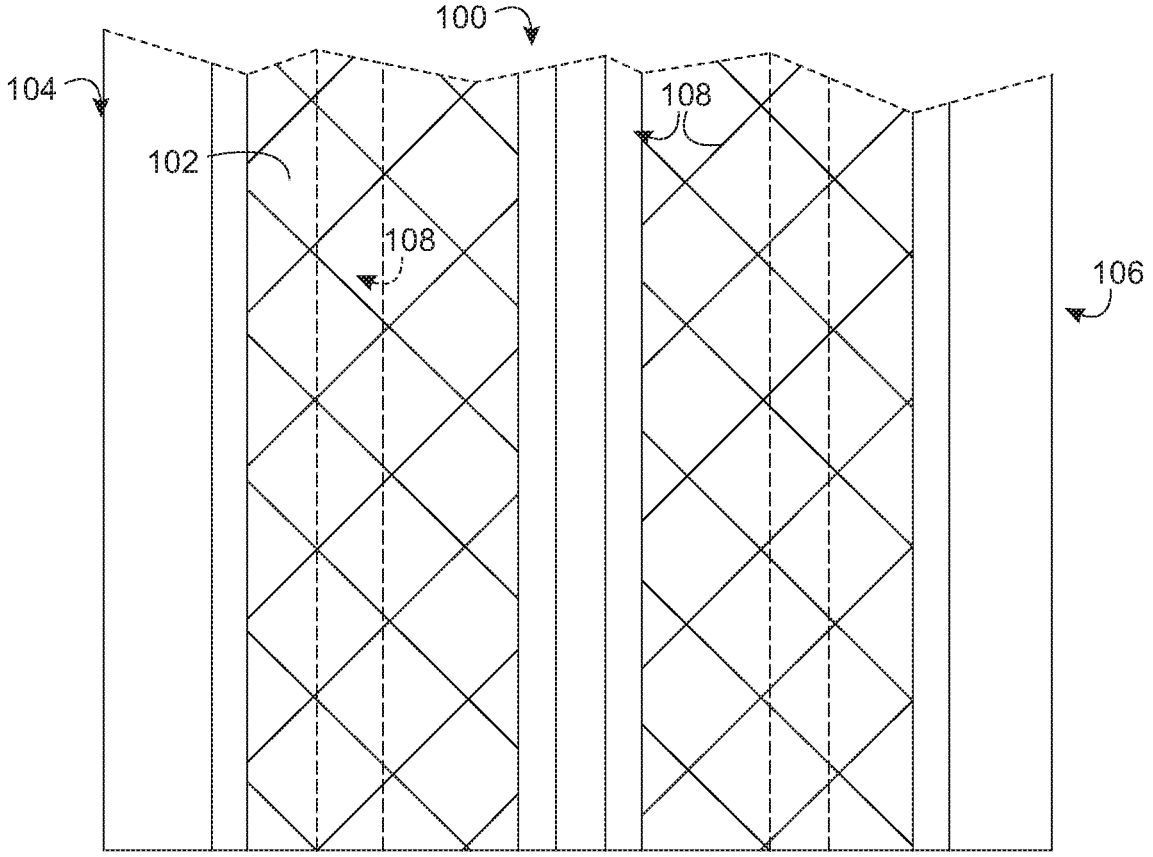
FIG. 1 presents a top view of a covering structure, in accordance with aspects of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout FIGS. 1-4 is a covering structure 100 for a dock 302 or a deck. It is to be understood that the covering structure 100 may be used for any appropriate surface, such as decks, or any structure needing protection, durability, and low heat absorption.

Figure 3:
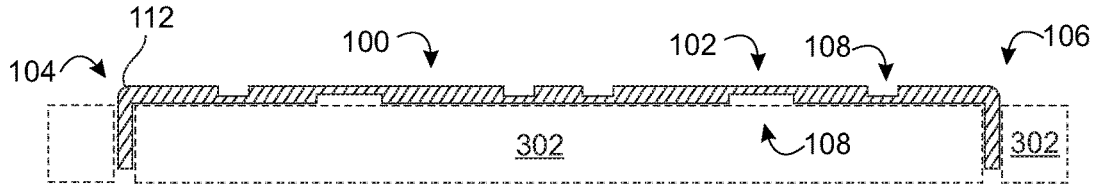
FIG. 3 presents a side elevation view of the coveting structure being installed on a dock, in accordance with aspects of the present disclosure.

The covering structure 100 may include a top surface 102. For example, the top surface 102 may be disposed upward when the covering structure 100 is installed on the dock 302 (FIG. 3). The top surface 102 may be a surface that is stepped on by a user, and that is exposed to direct sunlight, for example. The top surface 102 extends between a first edge 104 and a second edge 106 of the covering structure 100.

The top surface 102 may include one or more indentations 108. The one or more indentations 108 of the top surface 102 may extend between a third edge 402 and a fourth edge 404 and/or between the first edge 104 and the second edge 106. The third edge 402 and fourth edge 404 (FIG. 4) of the top surface 102 may be parallel with one another and perpendicular to the first edge 104 and second edge 106.

Figure 5:
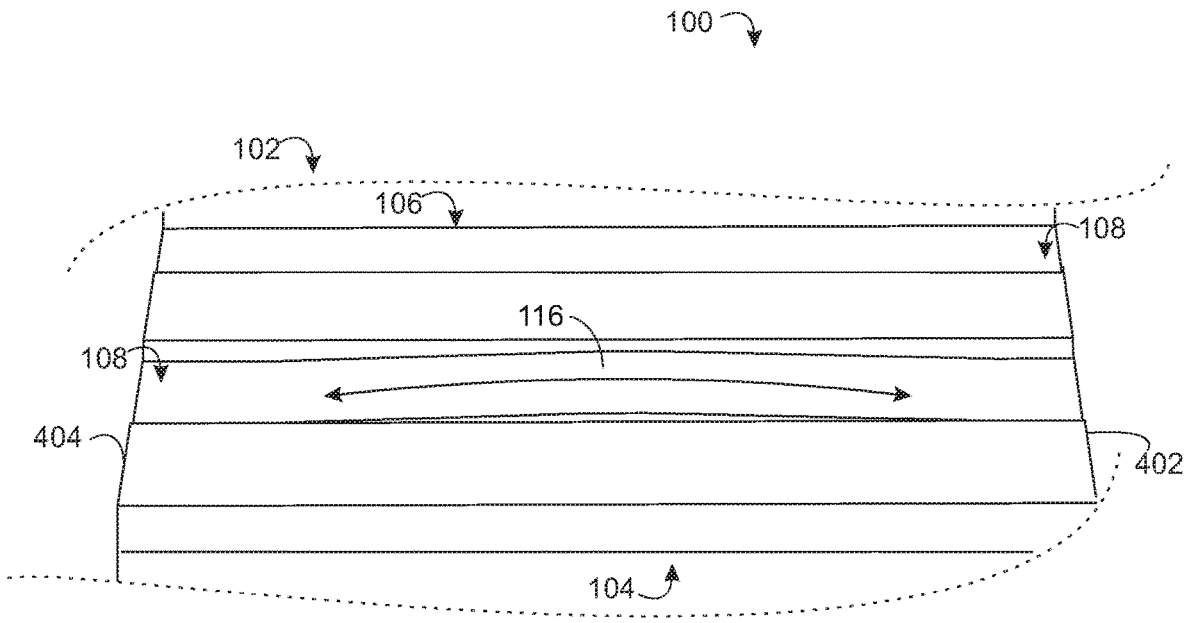
FIG. 5 presents a top perspective view of the covering structure originally shown in FIG. 4, illustrating a lower surface of one or more indentations of the top surface having a convex curved channel that extends from one edge to an opposite edge to facilitate drainage off the sides of the covering structure.

With quick reference to FIG. 5, the one or more indentations 108 of the top surface 102 may be configured to drain fluid. For example, rain may be trapped within the one or more indentations 108 of the top surface 102 for drainage off the edges of the covering structure 100. A lower surface of the one or more indentations 108 of the top surface 102 may be curved convex upward channel 116 that extends from one edge (e.g. 404) to an opposite edge (e.g. 402) with the channel cresting to provide opposite sloping surfaces (signaled by the double arrow line) to facilitate drainage off the sides of the covering structure 100.

Figure 2:
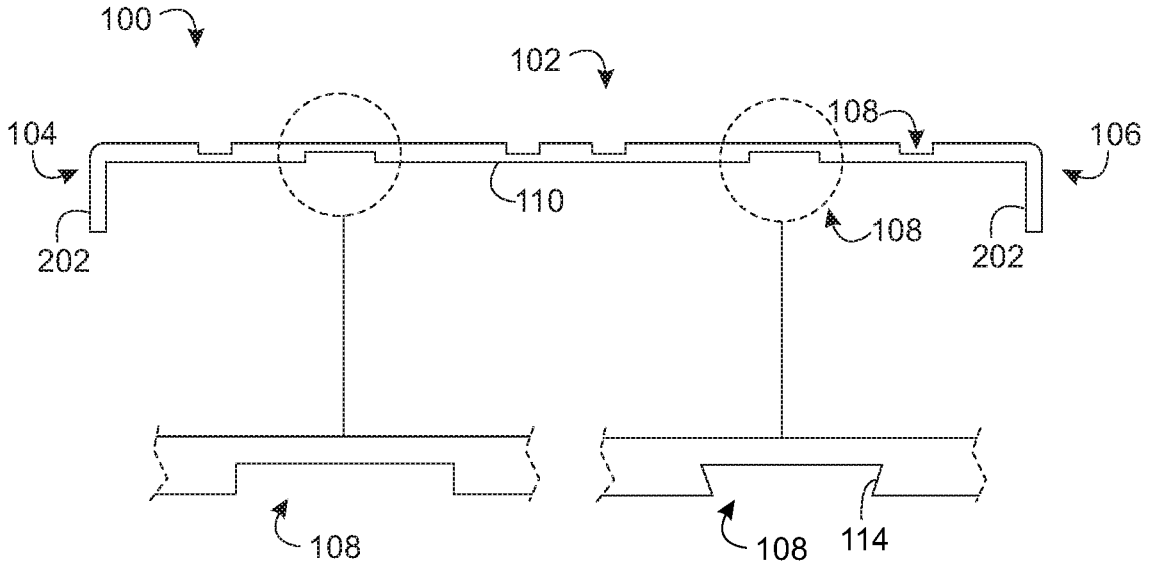
FIG. 2 presents a side elevation view of the covering structure, in accordance with aspects of the present disclosure.
Figure 4:
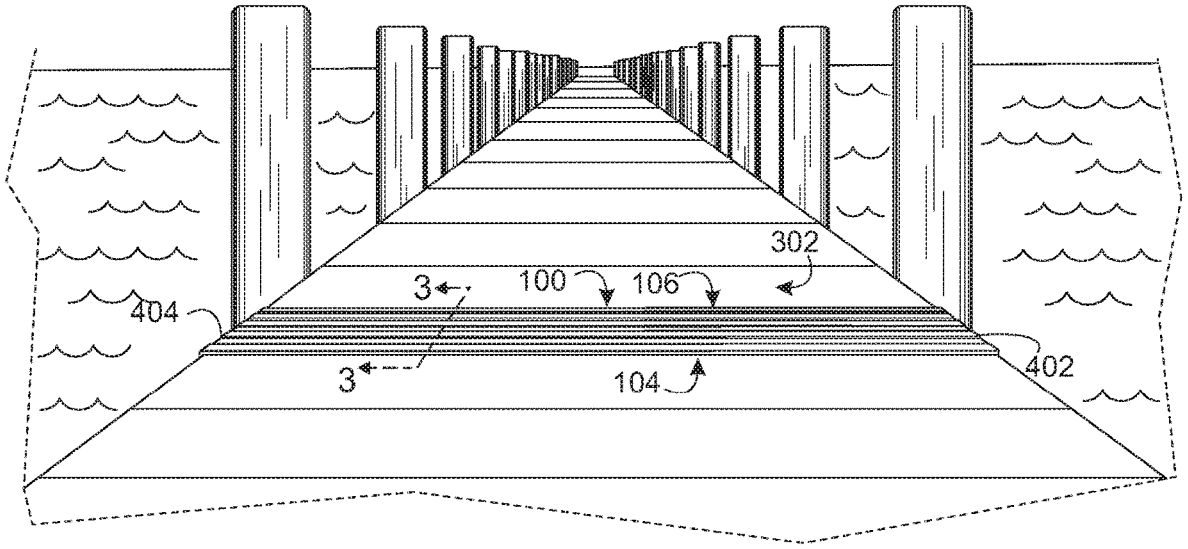
FIG. 4 presents a perspective view of the covering structure being installed on a dock, in accordance with aspects of the present disclosure.

Referring now to FIGS. 2, 3 and 4, the covering structure 100 may include a bottom surface 110. The bottom surface 110 may extend between the first edge 104 and the second edge 106. The first edge 104 and second edge 106 of the covering structure 100 includes a top radiused edge 112 (FIG. 3). The bottom surface 110 may be disposed downward when the covering structure 100 is installed on the dock 302. The bottom surface 110 may include one or more indentations 108. The one or more indentations 108 of the bottom surface 110 may extend between a third edge 402 and a fourth edge 404, and/or the first edge 104 and second edge 106 (FIG. 4). The third edge 402 and fourth edge 404 of the bottom surface may be parallel with one another and perpendicular to the first edge 104 and second edge 106. The bottom surface 110 and top surface 102 may share one or more edges described herein.

The one or more indentations 108 of the bottom surface 110 may be configured to receive an adhesive for gripping the dock 302. The one or more indentations 108 of the bottom surface 110 may have one or more sloped walls 114 (FIG. 2), such that the one or more indentations 108 of the bottom surface 110 have a wider top than a bottom of the one or more indentations 108 of the bottom surface 110.

The one or more indentations 108 of one or both of the top surface 102 and bottom surface 110 may include a groove that is extruded in a manufacturing process of the covering structure 100. The one or more indentations 108 may be effected by an embossing wheel to roughen at least one of the top surface 102 and bottom surface 110. Therefore the one or more indentations 108 may be or include grooves or scratches. In one example, the one or more indentations 108 are formed in an extrusion process.

At least one of the top surface 102 and the bottom surface 110 may be textured and/or roughened to improve grip. For example, the top surface may be roughed by an embossing wheel to increase friction between the covering structure 100 and a user's foot or shoe. The bottom surface 110 may be roughened to increase gripping ability to adhesive under the bottom surface 110, adhering the bottom surface 110 to the dock 302.

The covering structure 100 may include a downward projection 202 on each of the first edge 104 and the second edge 106. The downward projections 202 may extend along each of the first edge 104 and the second edge 106. The downward projections 202 may form a lip that extends below the bottom surface 110. The downward projections 202 may also extend along third and fourth edges 402 and 404.

The covering structure 100 may be configured to be installed on a dock 302, by extending laterally over the dock 302, such that the downward projections 202 on each of the first edge 104 and the second edge 106 extend downwardly over vertical sides of the dock 302, for example, between floorboards of the dock as shown in FIG. 3. The downward projections 202 may cover and protect at least a portion of vertical sides of the dock 302. The downward projections 202 may cover any appropriate vertical portion of the dock, either laterally or longitudinally, at the end or beginning of the dock, or along any appropriate side edge.

It is to be understood that the structure 100 may be configured such that the downward projections 202 fit on opposite edges of a floorboard of the dock 302, such that the floorboard fits in a space defined between the downward projections 202, as shown throughout the figures.

The covering structure 100 may be made of any material, or combination of materials, that are resistant to heat absorption. This prevents harming or burning skin of a user touching the covering structure (e.g. stepping on the covering structure). The selected materials of the covering structure 100 may also be resistant to ultra-violet radiation.

The covering structure 100 may be entirely a single piece, and may be manufactured by extrusion. In some embodiments, the covering structure 100 is made of wood, composites, aluminum, plastic, or any combination thereof, but while still being a material that solves the problems mentioned in the background section especially relating to heat absorption and durability.

Further disclosed is a method of covering a dock 302. The method may include providing a covering structure 100 for a dock 302, the covering structure 100 comprising, a top surface 102 and a bottom surface 110, wherein the top surface 102 and bottom surface 110 extend between a first edge 104 and a second edge 106, wherein at least one of the top surface 102 and the bottom surface 110 includes one or more indentations 108. Further, the method includes placing or installing the covering structure 100 on the dock. Further, the covering structure 100 may include a downward projection 202 on each of the first edge 104 and the second edge 106, and the method further may include placing the projections on opposite vertical sides of the dock 302, and/or vertically between floorboards of the dock 302. The method may further comprise placing an adhesive on the dock 302 before placing the covering structure 100 on the dock 302, such that the covering structure 100 is placed on the adhesive to adhere the covering structure 100 to the dock 302. The method may further include roughening at least one of the top surface 102 and bottom surface 110 using an embossing wheel.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A covering structure for a flooring, the covering structure comprising:

a top surface;

a bottom surface;

wherein the top surface and bottom surface extend between a first edge and a second edge, the first edge and the second edge each have a radiused top edge; and wherein the top surface and the bottom surface include a first set of one or more indentations, and further wherein the top surface includes a second set of one or more indentations that include a convex curved channel extending longitudinally between a pair of opposite edges configured to facilitate drainage of fluid.

2. The covering structure of claim 1, wherein the covering structure includes a downward projection on at least one of the first edge and the second edge.

3. The covering structure of claim 1, wherein the covering structure includes a downward projection extending along at least one of the first edge and the second edge.

4. The covering structure of claim 1, Therein the first set and second set of one or more indentations extend between a third edge and a fourth edge, wherein the third edge and fourth edge are parallel with one another and perpendicular to the first edge and second edge.

5. The covering structure of claim 1, wherein the second set of one or more indentations that include the curved channels are configured to drain fluid.

6. The covering structure of claim 1, wherein the structure is configured to be installed on a flooring, wherein the covering structure includes a downward projection on at least one of the first edge and the second edge to extend downwardly over at least one vertical side of a floorboard of the flooring.

7. The covering structure of claim 1, wherein the structure is configured to be installed on a flooring, wherein the covering structure includes a downward projection extending along at least one of the first edge and the second edge to extend downwardly over at least one vertical side of the flooring.

8. The covering structure of claim 1, wherein the first set of one or more indentations on the bottom surface are configured to receive an adhesive for gripping the flooring.

9. The covering structure of claim 8, wherein the first set of one or more indentations on the bottom surface have one or more sloped walls.

10. The covering structure of claim 9, wherein the first set of one or more indentations on the bottom surface have a wider top than a bottom.

11. The covering structure of claim 1, wherein the first set of one or more indentations includes a groove that is extruded in a manufacturing process of the covering structure.

12. The covering structure of claim 1, wherein the first set and second set of one or more indentations are effected by an embossing wheel to roughen at least one of the top surface and bottom surface.

13. The covering structure of claim 1, wherein the covering structure is resistant to ultra-violet radiation and heat.

14. The covering structure of claim 1, wherein the covering structure is entirely a single piece.

15. The covering structure of claim 1, wherein at least one of the top surface and the bottom surface are at least one of textured and roughened to improve grip.

16. A covering structure for a flooring, the covering structure comprising:

a top surface;

a bottom surface;

wherein the top surface and bottom surface extend between a first edge and a second edge;

wherein the first edge and second edge each have a radiused top edge;

wherein the top surface and the bottom surface includes a first set of one or more indentations;

wherein the top surface includes a second set of one or more indentations that include a convex curved channel extending longitudinally between a pair of opposite edges, wherein the channel crests to provide opposite facing surfaces sloping toward a respective opposite edge to facilitate drainage of fluid;

wherein the covering structure includes a downward projection extending along at least one of the first edge and the second edge;

wherein the first set and the second set of one or more indentations extend between a third edge and a fourth edge, wherein the third edge and fourth edge are parallel with one another and perpendicular to the first edge and second edge;

wherein the second set of one or more indentations are configured to drain fluid;

wherein the structure is configured to be installed on a flooring, the downward projections extend downwardly over at least one of at least one vertical side of the flooring and at least one side of a floorboard of the flooring;

wherein the first set of one or more indentations are configured to receive an adhesive for gripping the flooring;

wherein the first set of one or more indentations on the bottom surface have one or more sloped walls;

wherein the first set of one or more indentations on the top surface includes a groove that is extruded in a manufacturing process of the covering structure;

wherein the covering structure is resistant to ultra-violet radiation and heat;

wherein the covering structure is entirely a single piece; and wherein at least one of the top surface and bottom surface are roughened.

17. A method of covering a flooring, the method comprising:

providing a covering structure for a flooring, the covering structure comprising, a top surface and a bottom surface, wherein the top surface and bottom surface extend between a first edge and a second edge, the first edge and the second edge each have a radiused top edge, wherein the top surface and the bottom surface includes a first set of one or more indentations, and the top surface includes a second set of one or more indentations that include a convex curved channel extending longitudinally between a pair of opposite edges, wherein the channel crests to provide opposite facing surfaces sloping toward a respective opposite edge to facilitate drainage of fluid; and placing the covering structure on the flooring.

18. The method of claim 17, wherein the covering structure includes a downward projection on at least one of the first edge and the second edge; and wherein the method further comprises placing the projections on at least one vertical side of at least one of the flooring and at least one vertical side of a floorboard of the flooring.

19. The method of claim 17, wherein the method further comprises placing an adhesive on the flooring before placing the covering structure on the flooring, such that the covering structure is placed on the adhesive to adhere the covering structure to the flooring.

20. The method of claim 17, wherein the method further comprises roughening at least one of the top surface and bottom surface with an embossing wheel.

* * * * *